US005792390A

United States Patent [19]

Marino

[11] Patent Number: 5,792,390

[45] Date of Patent: Aug. 11, 1998

[54] HUMIDIFIER WITH TOP FILL TANK

[75] Inventor: Francis E. Marino, Upton, Mass.

[73] Assignee: Holmes Products Corp., Milford, Mass.

[21] Appl. No.: 780,741

[22] Filed: Jan. 8, 1997

Related U.S. Application Data

[60] Provisional application No. 60/009,913, Jan. 11, 1996.

[51] Int. Cl.[6] ..... B01F 3/04

[52] U.S. Cl. ..... 261/72.1; 215/359

[58] Field of Search ..... 261/72.1; 215/359

[56] References Cited

U.S. PATENT DOCUMENTS

| | | | |
|---|---|---|---|
| 2,292,149 | 8/1942 | Moeller | 215/359 |
| 2,685,380 | 8/1954 | Moeller | 215/359 |
| 2,729,353 | 1/1956 | Moeller | 215/359 |
| 4,353,847 | 10/1982 | Sato et al. | 261/721 |
| 4,921,639 | 5/1990 | Chiu | 261/81 |
| 4,930,657 | 6/1990 | Walker | 215/359 |
| 5,061,405 | 10/1991 | Stanek et al. | 261/721 |
| 5,447,663 | 9/1995 | Dix et al. | 261/721 |
| 5,480,588 | 1/1996 | Tomasiak et al. | 261/721 |
| 5,482,190 | 1/1996 | Stanek et al. | 261/721 |
| 5,529,726 | 6/1996 | Glenn | 261/30 |

OTHER PUBLICATIONS

Holmes Cool Mist Humidifier Model No. HM–1700, Catalog Sheet From Holmes Product Catalog, 1995.

Holmes Warm Mist Humidifier Model No. HM–5450, Catalog Page From Holmes Product Catalog, 1995.

Holmes Visible Mist Humidifier Model No. HM–460B, Catalog Page From Holmes Products Catalog, 1994.

*Primary Examiner*—Tim R. Miles

*Attorney, Agent, or Firm*—Hoffman & Baron, LLP

[57] ABSTRACT

A humidifier includes a base unit defining a reservoir for retaining a liquid. A liquid supply tank is also provided which is supported by and positionable within the base unit. The tank further includes an aperture defined by an aperture wall disposed on the top wall of the tank in order to permit the liquid to be introduced into the tank. The humidifier also includes a plug assembly having an outer diameter dimensioned for being insertable into the tank aperture. The plug assembly has a mechanism for increasing the plug's outer diameter. Such that when the plug assembly is inserted in the aperture, actuation of the mechanism for increasing the outer diameter urges the plug assembly against the aperture wall thereby sealing the aperture.

22 Claims, 11 Drawing Sheets

HUMIDIFIER WITH TOP FILL TANK

This application claims the benefit of U.S. Provisional Application No. 60/009,913, filed on Jan. 11, 1996.

FIELD OF THE INVENTION

The present invention relates generally to a humidifier. More particularly, the present invention relates to a portable humidifier having an improved top filled water tank having a fill hole sealed by a snap plug assembly.

BACKGROUND OF THE INVENTION

In general, humidifiers vaporize water and expel the vapor into the surrounding environment in order to increase the moisture content thereof. Such increased humidity may be desirable in order to improve the comfort level for individuals experiencing the humidified air. While humidifiers may be used in a variety of circumstances, they are especially useful in maintaining a comfortable humidity level in otherwise low humidity conditions. Humidifiers are available in a variety of sizes and designs and include both console units and portable units. Console units typically are large stationary units having the humidifying capacity to affect large areas such as an entire house. Portable units are smaller in size and usually have the humidifying capacity to meet the requirements of a single room. Portable humidifiers due to their small size permit them to be moved from room to room as required. In addition, portable humidifiers utilize various means of producing the water vapor including heating coils, ultrasonic transducers and evaporative wicks.

Conventional construction of a portable humidifier includes a base unit containing a water reservoir in which the water is held just prior to vaporization by a humidification device. Water is supplied to the reservoir by a supply tank which is removably supported in the base. The tank may be removed as required in order to replenish the water supply. Water is typically introduced into the tank through a fill hole which is covered by a removable cap.

Water is typically transferred from the tank to the base reservoir through a valve assembly disposed in the bottom of the tank. When the tank is placed in the base, the valve engages a member on the base which urges the valve into an open position thereby allowing the water to flow into the reservoir. As water flows from the tank to the reservoir, air simultaneously is drawn into the tank through the valve by the vacuum created from the exiting water. When the water level in the reservoir rises to such a degree that the valve opening becomes covered with water, a hydrostatic balance is reached and the flow of water ceases. As water is vaporized, the reservoir level drops disturbing the balance and resulting in the continued flow of water from the tank. This controlled flow cycle ensures that the humidification device will have a supply of water with which to vaporize, as well as limiting the amount of water such that no water spills over the edges of the base reservoir. In order for this fluid control mechanism to be effective, the supply tank must be airtight with the only opening being through the valve assembly. If air is permitted to enter the tank by another means, the water may flow continuously into the base reservoir allowing spillage to occur.

In conventional humidifiers the only opening into the tank other than through the valve is through the fill hole. Therefore, it is very desirable that the cap covering the fill hole provide an airtight seal. The fill hole is usually located on the bottom of the tank adjacent the valve assembly and is covered by a cap that is threadedly secured to the tank upon rotation of the cap. An air tight seal is achieved by use of an elastomeric gasket which engages a portion of the tank adjacent to the fill hole.

The conventional design described above creates various problems for the user of such a device. First, in order to properly seal the fill hole, the cap must be tightly secured to the tank. This typically requires exerting a significant amount of torque on the cap in order to force the elastomeric seal tightly against the tank. As previously stated, it is imperative that the cap is tightly secured to the tank in order to prevent air from entering the tank from around the seal as opposed to through the valve. However, when the cap is so tightly secured, it then becomes difficult to subsequently remove the cap when refilling the tank is required. The opening and closing of the fill hole cap can be especially difficult for individuals having reduced manual dexterity resulting from arthritis or other physical ailments.

Second, since the cap must be rotated until it can be no longer turned by the user, it is difficult to determine whether or not the cap is adequately secured to the tank. Therefore, a user tends to exert as much force as possible on the cap in order to ensure its proper securement. However, there is no easy way to ensure that the cap is properly secured, such as by visual inspection.

Third, since the fill hole is located at the bottom of the tank, the tank must be inverted in order to refill the water supply. This tends to be a difficult task especially when the tank has been filled and must be turned to the upright position for installation back into the base. Once the tank has been filled, it is both heavy and slippery making the tank difficult to manage. Such tanks may hold as much as 2.5 gallons of water giving them a filled weight of approximately 20 lbs. A tank under these conditions is difficult to manage and may slip out of the users hands and fall, resulting in damage to the tank.

Accordingly, it is desirable to provide a humidifier having a tank with a fill hole located thereon so that it does not require the tank to be inverted in order to fill it. It is also desirable to provide a humidifier tank having a fill hole sealing device which is easily installable and provides visual verification of its proper installation.

SUMMARY OF THE INVENTION

It is an object of the present invention to provide a humidifier with a water supply tank having a fill hole located on a top wall of the tank in order to facilitate easy filing of the tank.

It is a further object of the present invention to provide a humidifier including a tank having a snap plug assembly for providing an airtight seal of the fill hole.

It is yet another object of the present invention to provide humidifier including a tank having a snap plug assembly with an interlocking device such that the tank may not be properly seated in a base unit unless the snap plug assembly is properly secured.

In the efficient attainment of these and other objects the present invention provides a humidifier having a top fill tank. The humidifier includes a base unit defining a reservoir for retaining a liquid. A liquid supply tank is also provided which is supported by and positionable within the base unit. The tank has a bottom wall perimetrically bounded by an upper wall extending upwardly therefrom and terminating in a top wall. The bottom wall includes a valve assembly communicating with the reservoir. The tank further includes an aperture defined by an aperture wall disposed on the top wall of the tank in order to permit the liquid to be introduced into the tank. The aperture wall may be tapered decreasing in diameter as the aperture wall extends toward the tank interior.

The humidifier also includes a plug assembly having an outer diameter dimensioned for being insertable into the tank aperture. The plug assembly has a mechanism for increasing the plug's outer diameter, such that when the plug assembly is inserted in the aperture, actuation of the mechanism for increasing the outer diameter urges the plug assembly against the aperture wall thereby sealing the aperture.

A humidification device for vaporizing the liquid and discharging the vaporized liquid into the environment is further included in the humidifier.

As more specifically described by way of the preferred embodiment herein, the plug assembly further includes a plug formed of an elastomeric material. The plug has a top and bottom end and wherein the mechanism for increasing the outer diameter urges the top and bottom ends axially together resulting in the increase of the plug assembly diameter. The mechanism for increasing the outer diameter includes a connecting rod having two ends extending through the plug and an actuator rotatably connected to one end of the connecting rod. A stop fixedly secured to the other end of the rod is provided. Such that upon rotation of the actuator, the plug is compressed toward the stop thereby increasing the diameter of the plug assembly.

The plug assembly also includes an interlocking device which is engagable with the base unit for preventing placement of the tank into the base unit if the tank aperture is not properly sealed. The interlocking device includes the actuator, and the actuator has a lever which extends outwardly in a radial direction when the actuator is in a closed position and the lever extends in an axial direction when the actuator is in an opened position. Such that when the plug assembly is inserted into the tank aperture and the actuator is in the opened position, the lever engages the base unit thereby preventing the tank from being properly positioned within the base unit.

A preferred form of the humidifier, as well as other embodiments, objects and advantages of this invention, will be apparent from the following detailed description of the illustrative embodiments thereof, which is to be read in connection with the accompanying drawings.

DETAILED DESCRIPTION OF THE PREFERRED EMBODIMENTS

Figure 1:
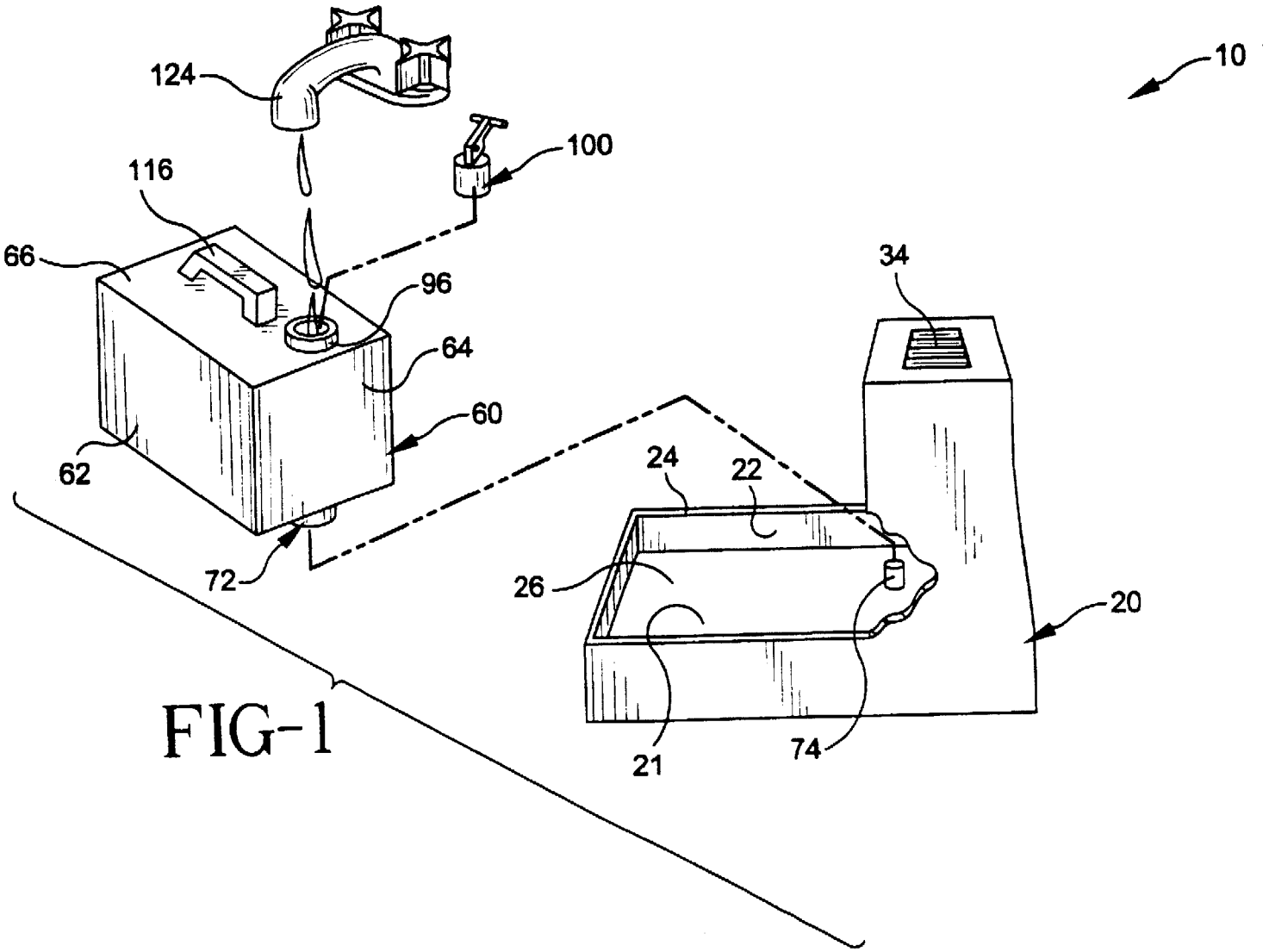
FIG. 1 is an exploded perspective view of the humidifier of the present invention.
Figure 2:
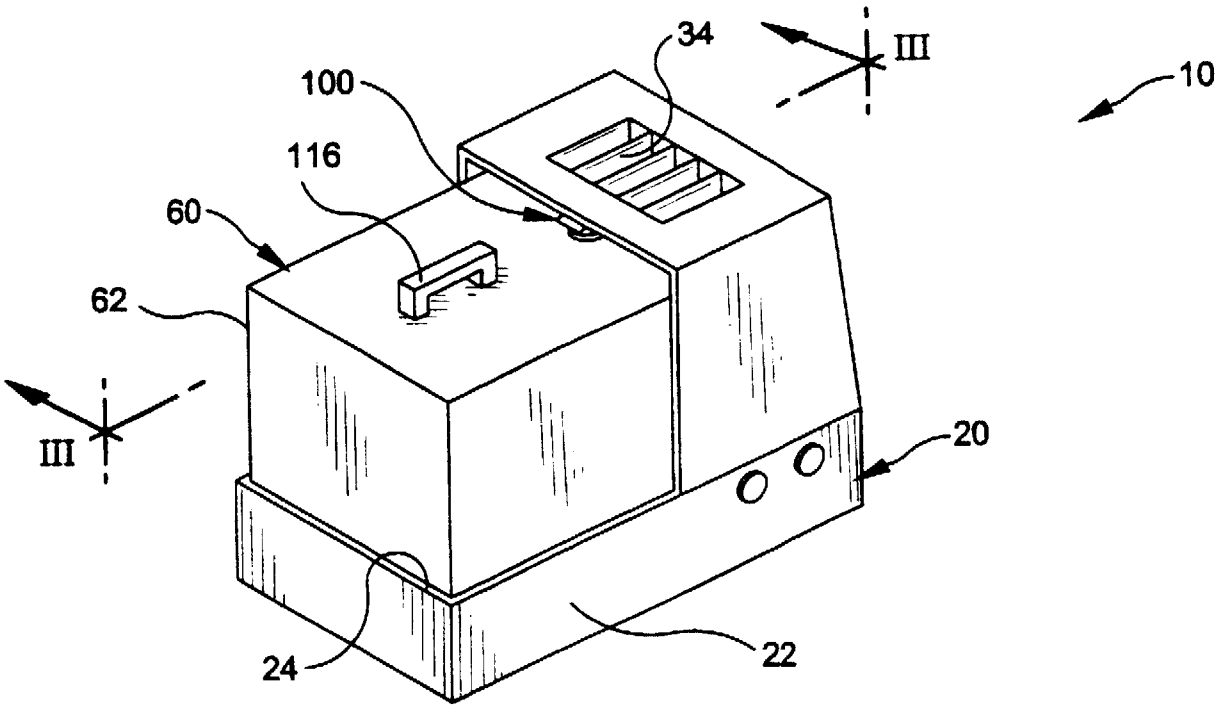
FIG. 2 is a perspective view of the humidifier of FIG. 1 with a water tank assembly inserted within a base unit.

Referring to FIG. 1, a preferred embodiment of the portable humidifier of the present invention is shown. Humidifier 10 includes a base unit 20, a water tank assembly 60 and a snap plug assembly 100. Base unit 20 is adapted to receive tank assembly 60 as shown in FIG. 2, such that tank assembly 60 is insertable and removable therefrom. Tank assembly 60 provides a storage container for water prior to its vaporization by the humidifier.

Figure 3:
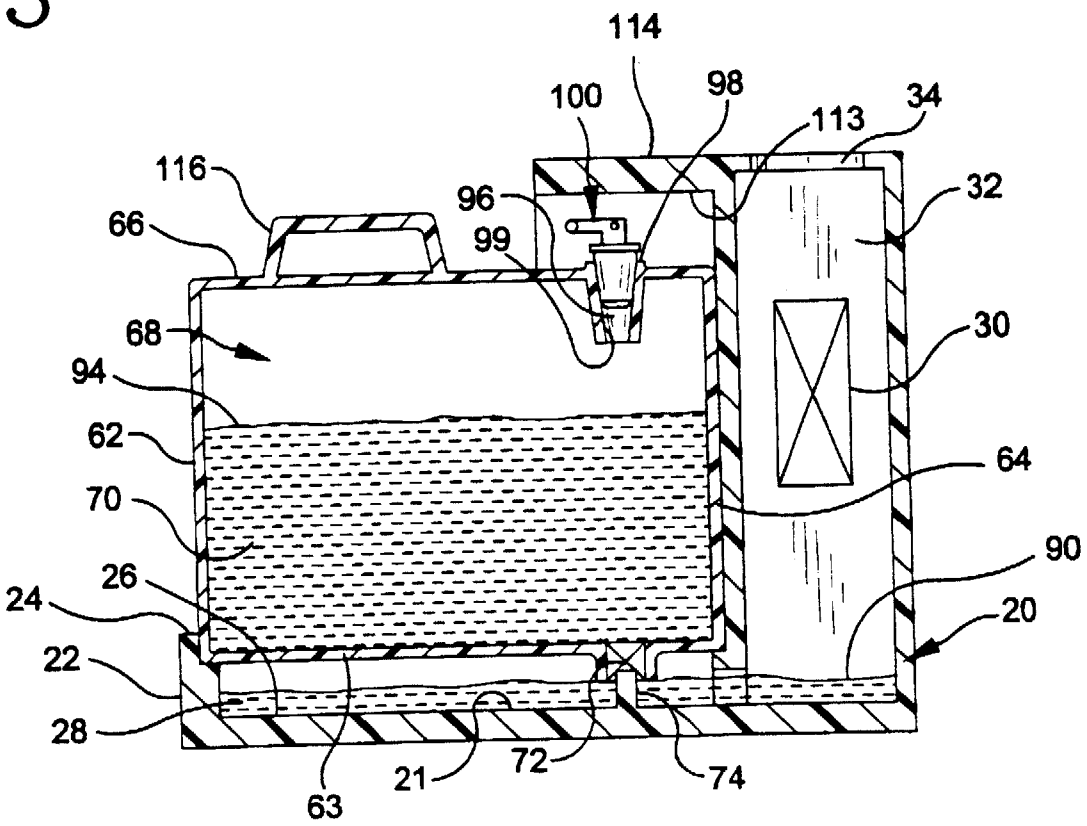
FIG. 3 is a partial vertical cross-sectional view of the humidifier of FIG. 2 taken along lines III—III.

With further reference to FIG. 3, base unit 20 includes a bottom portion 21 having a wall portion 22 extending upwardly therefrom and terminating in a rim 24. Wall portion 22 defines a basin like base reservoir 26 that is capable of holding a limited quantity of water. When tank assembly 60 is inserted into base 20, water flows from tank assembly 60 into reservoir 26 in a manner that will be described in detail below. The water 28 in base reservoir 26 communicates with a humidification device 30 which is located within base unit 20. The humidification device 30 may be of any type well known in the art which causes the evaporating, nebulizing, heating or misting of the water. The vaporized water passes from a vaporization chamber 32 which extends upwardly from base bottom portion 21 out to the surrounding environment through vents 34. The expelled vapor results in increased humidity of the surrounding air. The base unit 20 may also contain controls for adjusting the rate of vaporization and the level of ambient humidity desired in a manner well known in the art.

Humidification device 30 may be of the evaporative wick type that includes a water absorbing wick (not shown) that is partially in contact with reservoir water 28. Reservoir water 28 is drawn up by the wick by capillary action thereby saturating the wick. Air is then forced over the wick by a fan (not shown) which is also disposed within the base unit 20. As air passes over the wick, water is absorbed by the air and is expelled into the ambient air resulting in increased humidity of the ambient air. The humidification device may also include a heating coil (not shown) that heats the water to a point where evaporation occurs. The vapor is then expelled from the vaporization chamber by either a fan or natural thermal extension of the heated vapor. In addition, the water may also be vaporized by an ultrasonic transducer in the manner well known in the art. It is within the contemplation of the present invention that the humidification device may be in the form of any of the variety of devices which are well known in the art.

Water is supplied to the humidification device 30 from base reservoir 26 by water tank assembly 60. Water tank assembly 60 includes a tank 62 having a bottom wall 63 perimetrically bounded by side wall 64 extending upwardly therefrom. Side wall 64 ends in a top wall 66 which may be substantially parallel to a bottom wall 63. Walls 63, 64, and 66 define a tank interior 68 which is capable of holding the water supply 70. A fill hole 96 is preferably provided in top wall 66 which allows for tank 62 to be easily filled from a water source 124 without the need for the tank to be inverted as is the case with conventional bottom fill tank designs. It is also within the contemplation of the present invention that fill hole 96 may be located on side wall 64 or even bottom wall 63. Tank 62 is sized to fit within base unit 20 and to be supported therein. The tank may be of a variety of different shapes and sizes in order to accommodate a particular aesthetic or functional design.

Referring to FIGS. 3 and 9A–9C, tank bottom wall 63 includes a conventional humidifier tank valve assembly 72 that prevents water from flowing from tank 62 when it is outside base 62, but allows water to exit the tank when the tank is inserted in the base. Valve assembly 72 is engageable with valve actuator 74 for permitting water to exit tank 62 to flow into base reservoir 26. Valve actuator 74 is preferably an elongate member extending upwardly from base unit 20 and positioned thereon such that it aligns with valve assembly 72 when tank 62 is seated within the base unit.

Figure 9A:
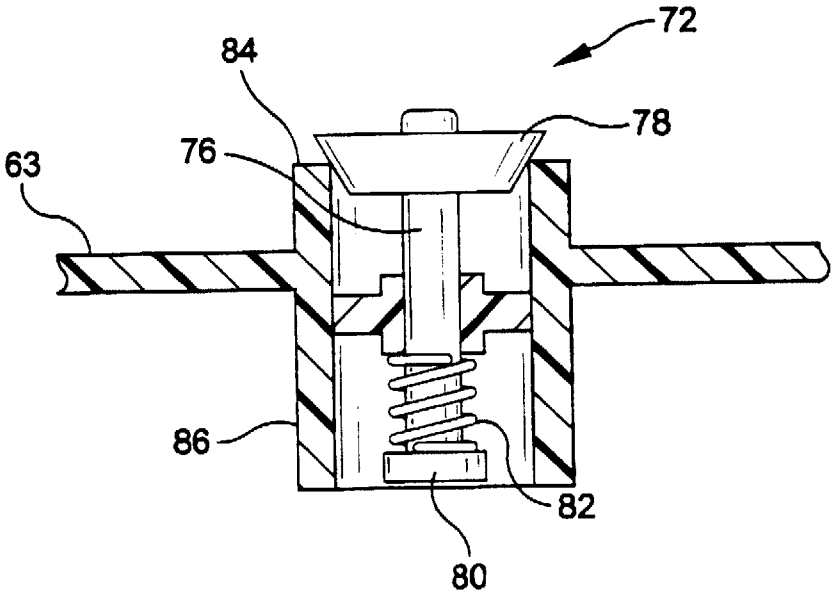
FIG. 9A is a partial sectional view of the valve assembly of the present invention showing the valve in the closed position.

As shown in FIG. 9A, valve assembly 72 may include a valve stem 76 having an elastomeric sealing element 78 disposed on one end, and a generally planar engagement surface 80 formed on the opposite end of stem 76. Valve stem 76 is movably supported in tank bottom wall 63 and is biased by a spring 82 which may be disposed about stem 76. Spring 82 forces the valve into a closed position. In the closed position, sealing element 78 engages a valve seat 84 thereby preventing water from exiting spout 86. The weight of water supply 70 within tank 62 forces sealing element 78 into engagement with valve seat 84 thereby providing even a tighter seal.

Figure 9B:
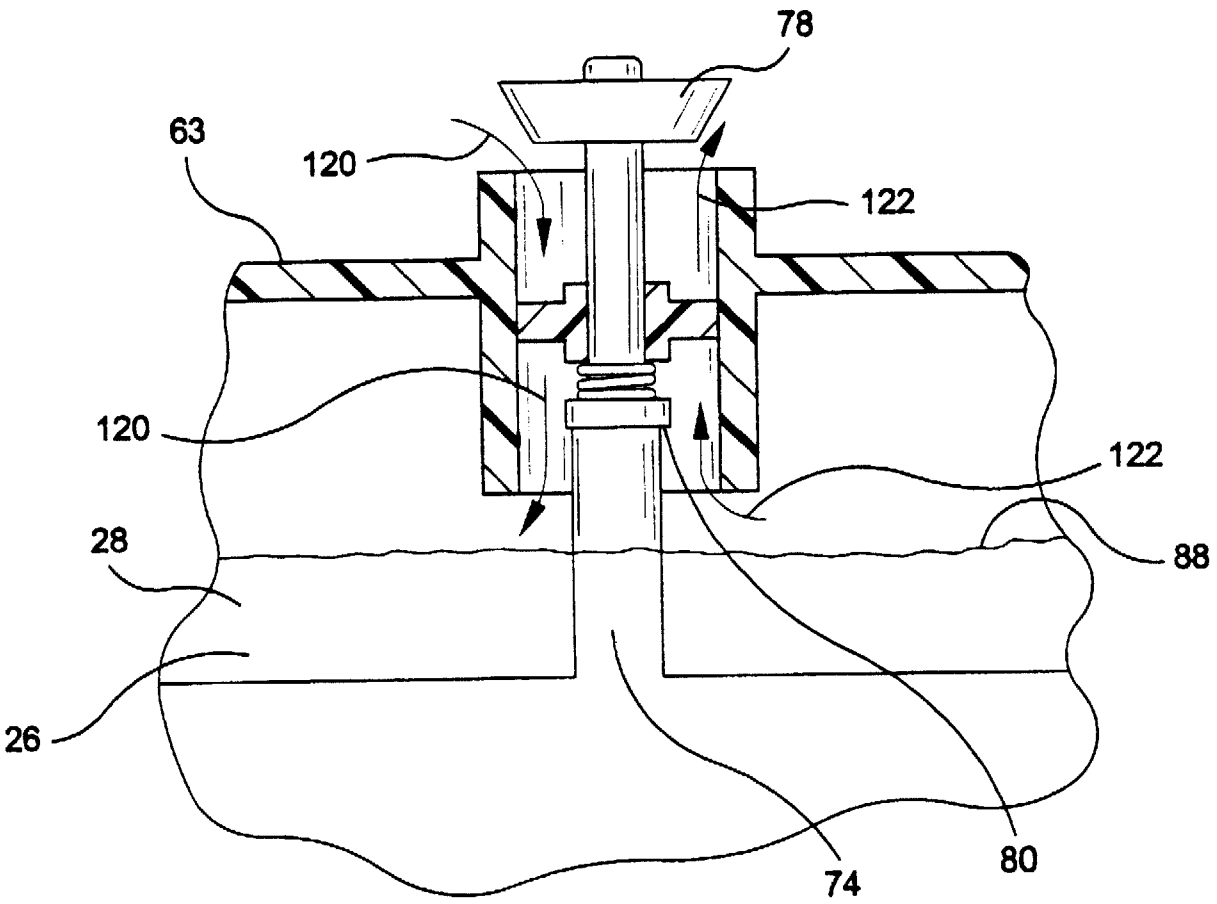
FIG. 9B is a partial sectional view of the valve assembly and base unit of the present invention showing the valve in the open position and the water level below the operating level.
Figure 9C:
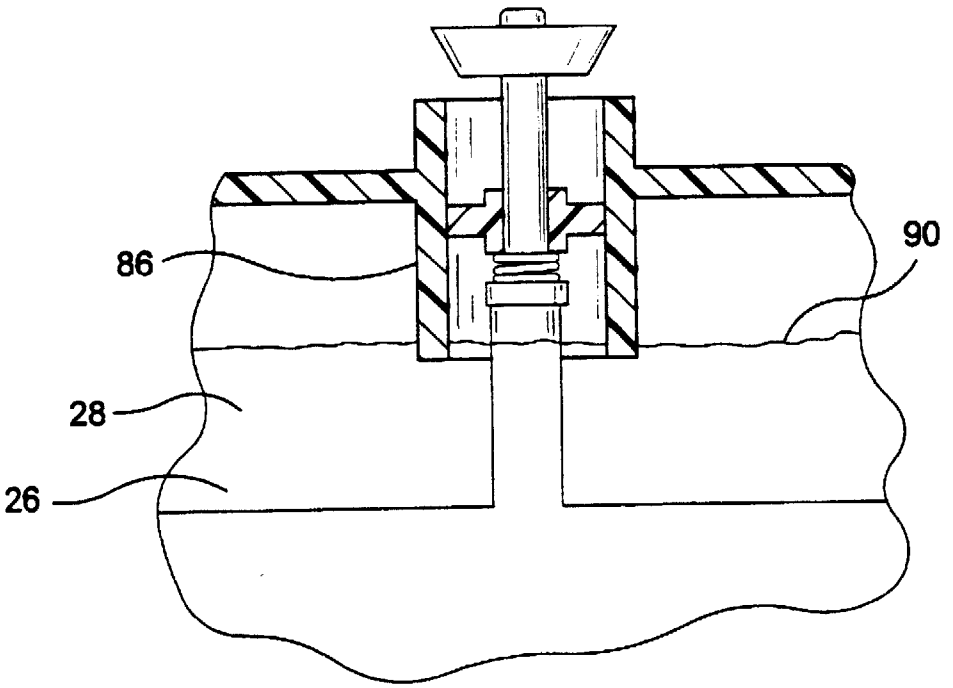
FIG. 9C is a partial sectional view of the valve assembly and base unit of the present invention showing the valve in the open position and the water level at the operating level.

Upon inserting tank assembly 60 into base unit 20, valve actuator 74 engages the engagement surface 80. Upon such engagement, valve stem 76 is moved upwardly and seal element 78 becomes unseated thereby opening the valve and allowing for the release of water as shown in FIG. 9B. When the valve is in the open position, exiting water 120 from tank 62 is replaced by air 122 coming in from around the base reservoir. The exiting water causes the level 88 of reservoir base water to rise until it reaches an operating level 90 as shown in FIG. 9C. At this level the valve spout 86 becomes submerged thereby preventing the further flow of air into tank 62. This condition ceases the flow of water from tank 62 and maintains the water level below the rim 24 of base wall portion 22. When water is evaporated by humidification device 30, the reservoir level drops and more water is allowed to flow from the tank. This process ensures an adequate supply of water in the reservoir for proper functioning of humidifier 10.

When the operating level of the water is reached, a slight negative pressure exists in the tank above water line 94 as shown in FIG. 3. It is very important that air not be allowed to enter the tank from any point other than through valve assembly 72, such as through the fill hole. Otherwise, the ability to limit the flow of water will be lost and water will flow continuously from the tank. This would result in spillage as the water level rises above the base wall rim 24. In conventional bottom fill tanks, the fill hole extends below base rim 24 so the failure to maintain an airtight seal only results in the reservoir level rising to the fill hole opening at which point the flow will stop. Therefore, the water level will not rise above base rim 24 and no spillage will occur. However, with placement of the fill hole above the bottom wall it is essential that an air tight seal be maintained in order to prevent spillage. The present invention provides for an airtight seal for fill hole 96 through the use of snap plug assembly 100. Therefore, fill hole 96 may be located at any position on the tank.

Referring to FIG. 3, fill hole 96 includes an annular wall portion 98 having an inner surface 99. The wall portion 98 may extend partially above and below top wall 66. The fill hole wall portion 98 is shaped to accommodate snap plug assembly 100. Snap plug assembly 100 is insertable into fill hole 96 and upon locking the snap plug into the position provides a seal which prevents the flow of air or water through the fill hole.

Figure 4B:
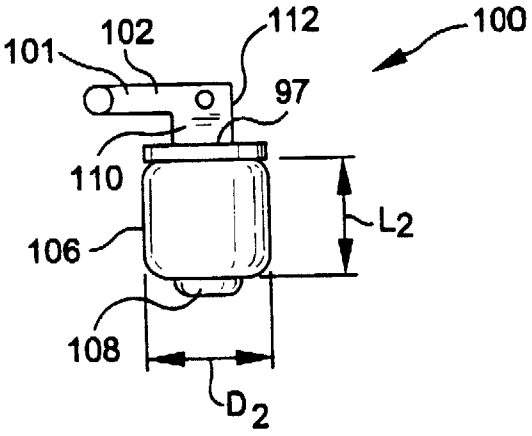
FIG. 4B is an elevational side view of the snap plug of FIG. 4A, shown in the expanded condition.
Figure 4A:
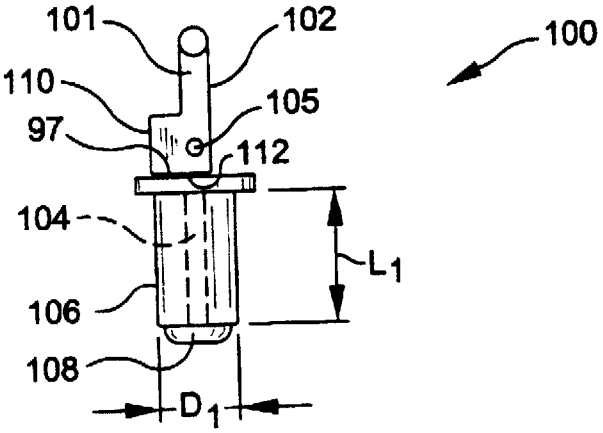
FIG. 4A is an elevational side view of a snap plug assembly shown in the contracted condition for use in the present invention.

Snap plug assembly 100, as shown in FIGS. 4A and 4B, includes a plug actuator 102 pivotally secured to one end of a connecting rod 104 by pin 105. Rod 104 extends through an elastomeric plug 106 and terminates in a lower stop 108. Lower stop 108 is preferably an annular disc which assists in securing rod 104 onto plug 106. Upon movement of actuator 102 about pin 105, plug 106 is linearly compressed between a first cam portion 110 of the actuator and lower stop 108. This results in diametrical expansion of the plug 108, as will be more fully described below. Therefore, when snap plug 100 is inserted into fill hole 96 and the actuator is moved to linearly compress plug 106, the perimeter of plug 106 is urged tightly against inner surface 99 of fill hole wall 98 providing an airtight seal. Snap plug assembly 100 also preferably includes a rigid upper plate 97 which may be disposed between the actuator and plug 106 such that the force exerted on the plug is uniformly distributed. Upper plate 97 further provides, smooth bearing surface over which cam portion 110 may traverse.

In the preferred embodiment, snap plug 100 is provided with only two stable conditions. A contracted condition as depicted in FIGS. 4A, 5B, 6B and 7, and an expanded condition as depicted in FIGS. 4B, 5C, 6C and 8. An elongate handle portion 101 of actuator 102 is movable between a radial orientation resulting in the contracted condition and an axial orientation resulting in the expanded condition. When actuator handle 101 is moved toward the radial orientation, first cam portion 110 of the actuator is urged against upper stop 97 causing a contraction in the linear dimension L2 and expansion in the diametric dimension D2 of elastomeric plug 106, as shown in FIG. 4B. The radial sealing pressure of the expanded plug 106 against the inner surface of the fill hole wall 99 prevents the flow of air from the higher outside pressure to the lower tank pressure. When actuator handle 101 is moved into the axial orientation, a second cam portion 112 allows plug 106 to contract toward its relaxed linear L1 and diametric D1 dimensions, as shown in FIG. 4A. In this contracted condition, plug assembly 100 may be inserted and removed from fill hole 96.

The natural bias of the elastomeric plug 106 toward its relaxed dimensions serves to urge actuator 102 toward the nearer of the expanded or contracted states and away from any state therebetween, so that the snap plug assembly may be positively locked into either the expanded or contracted condition. Manual positioning of the actuator into the radial orientation provides instant and positive sealing, with reliable indication of the same. By observing the position of the actuator, it is easily recognizable to a user when fill hole 96 is not properly sealed.

In order to properly seal fill hole 96 with snap plug assembly 100, the snap plug is first manually placed into the contracted condition by rotating actuator 102 toward the axial orientation. Plug 106 may then be inserted into fill hole 96. At this point actuator 102 may be rotated toward the radial orientation causing plug 106 to expand such that the plug 106 exerts a radial outward sealing force against cylindrical inner wall portion 99 of fill hole 96, thereby sealing fill hole 96. This sealing operation is very simple for an operator of the device. Unlike the conventional threaded sealing caps which require exerting a significant amount of torque to insure proper sealing, the snap plug assembly simply involves flipping the actuator between its two positions. Furthermore, the use of snap plug assembly 100 provides visual verification that the proper seal has been achieved in that the position of the actuator is readily apparent to a user of the device.

Figure 5A:
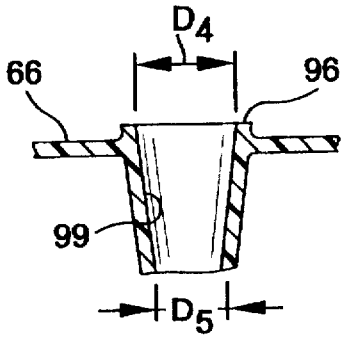
FIG. 5A is a partial sectional view of a tapered fill hole in accordance with the preferred embodiment of the present invention.
Figure 5B:
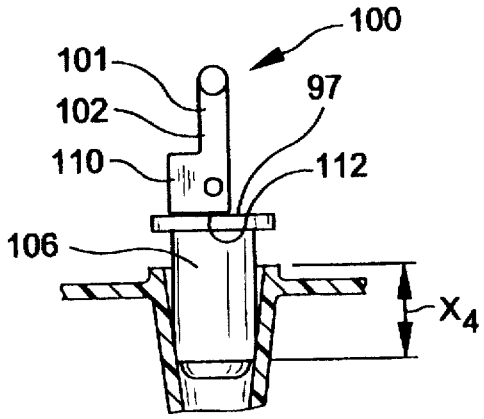
FIG. 5B is a partial sectional view of the tapered fill hole of FIG. 5A including the snap plug assembly shown in the contracted condition.
Figure 5C:
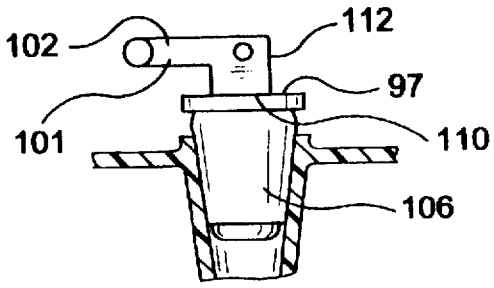
FIG. 5C is a partial sectional view of the tapered fill hole of FIG. 5A including the snap plug assembly shown in the expanded condition.
Figure 6A:
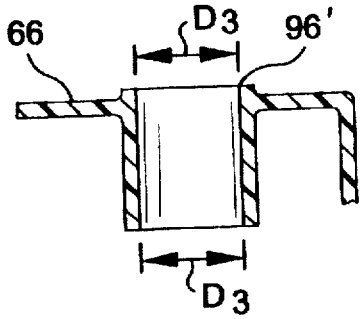
FIG. 6A is a partial sectional view of a cylindrical fill hole in accordance with an alternative embodiment of the present invention.
Figure 6B:
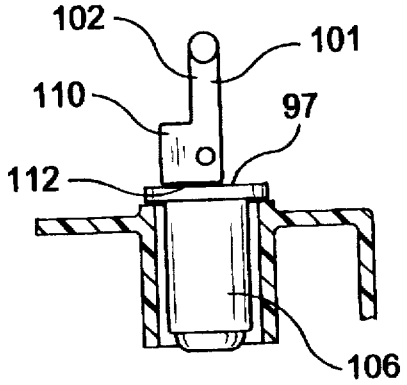
FIG. 6B is a partial sectional view of a cylindrical fill hole of FIG. 6A including the snap plug assembly shown in the contracted condition.
Figure 6C:
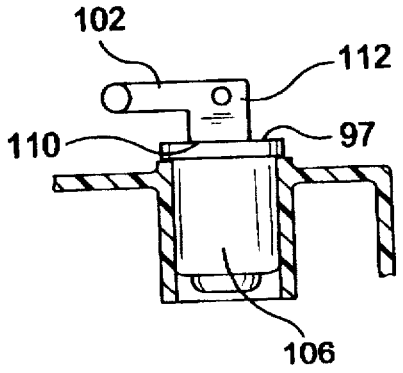
FIG. 6C is a partial sectional view of the cylindrical fill hole of FIG. 6A including the snap plug assembly shown in the expanded condition.

In the preferred embodiment, as shown in FIGS. 5A–5C, filler hole 96 has a tapered profile such that the inner diameter dimension D4 decreases inwardly toward the tank to diameter dimension D5. The inwardly decreasing diameter provides insurance against diametrical variations in the snap plug. For example, a plug of below normal contracted diameter D1 would be insertable deeper into fill hole 96 in order to accommodate the dimensional variation. Conversely, for plugs having an above normal contracted diameter, they would be inserted less deeply into the fill hole. This ability to accommodate dimensional variations is particularly applicable in instances where the plug diameter becomes reduced by long term compression in the fill hole during the expanded condition. In addition, the atmospheric pressure acting on the plug increases the sealing pressure by driving the plug further into the tapered hole, thereby benefiting from the imbalance of pressure across the plug. Plug 106 may have a uniform diameter as shown in FIGS. 4A–4B or, in an alternative embodiment (not shown), plug 106 may be tapered to correspond to the tapered fill hole 96 In an alternative embodiment, as shown in FIGS. 6A–6C, filler hole 96' may have a cylindrical profile having a uniform diameter D3. Snap plug assembly 100 operates substantially as described above with respect to FIGS. 5A–5C.

Figure 7:
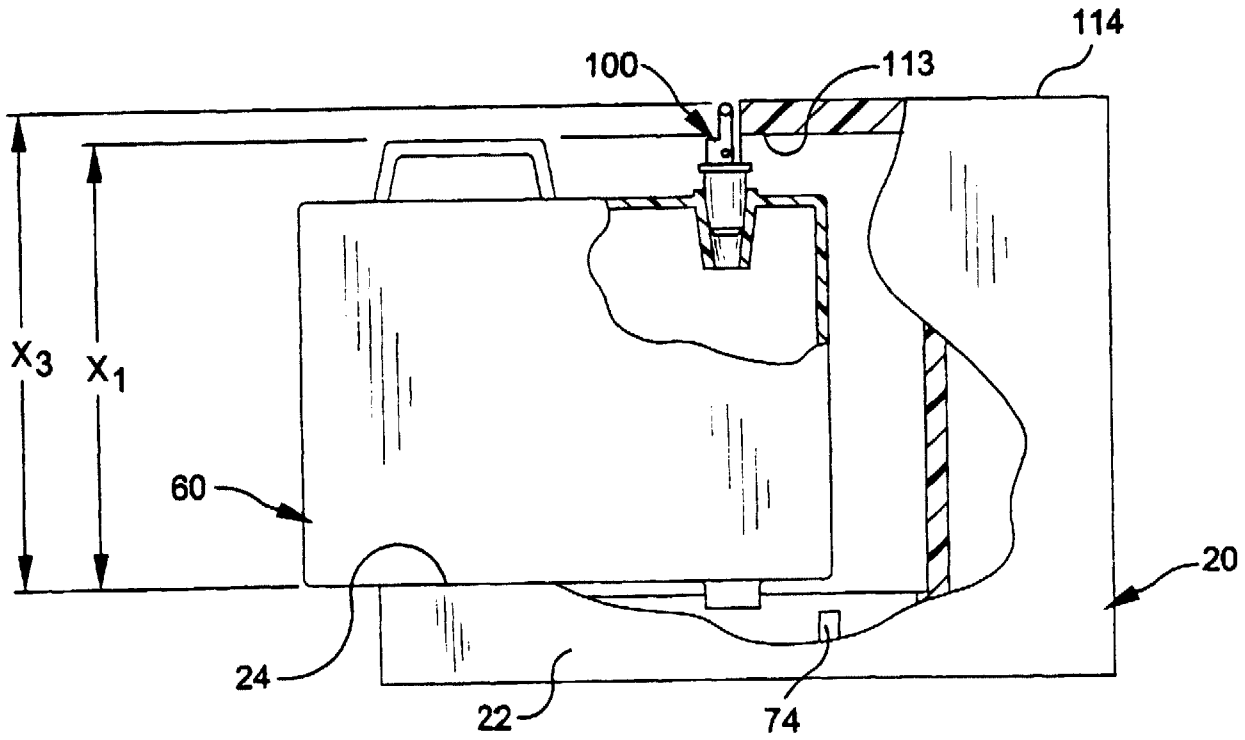
FIG. 7 is a broken side view of the humidifier of the present invention depicting attempted tank replacement with the snap plug in the open contracted condition.
Figure 8:
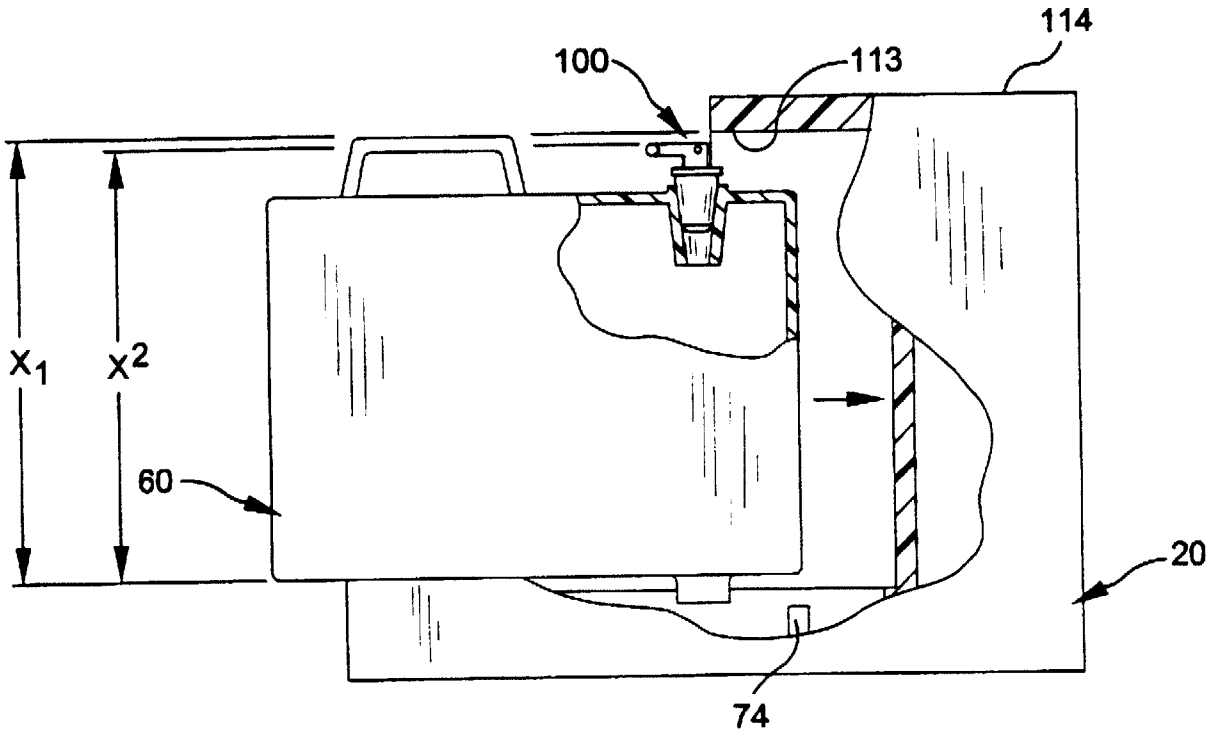
FIG. 8 is a broken side view of the humidifier of the present invention depicting attempted tank replacement with the snap plug in the closed expanded condition.

The present invention further provides an interlocking feature for preventing water tank assembly 60 from being positioned in base unit 20 with snap plug assembly 100 left in the open diametrically contracted position. Referring to FIGS. 7 and 8, the height dimension X1, from base wall rim 24 to the underside 113 of a base unit upper portion 114, is preferably selected to be less than the height dimension X3 of the tank assembly 60 having snap plug assembly 100 in the opened diametrically contracted condition with actuator 102 in the axial orientation. In addition, X1 is preferably greater than the height dimension X2 of tank assembly 60 having the snap plug in the closed expanded condition with actuator 102 in the radial orientation. Thus, tank assembly 60 will not fit under base unit upper portion 114 and be received by base unit 20 unless snap plug assembly 100 is in the closed expanded orientation. Such a design assists in assuring that the water tank is properly sealed prior to the tank being installed into the base unit and the valve assembly 72 being actuated.

In the preferred embodiment, tank assembly 60 may further include a handle 116 extending from top wall 66 of the tank. Handle 116 provides convenient means for holding tank assembly 60 during filling and removal and insertion of the tank into base 20. Since the fill hole is located on the top wall of the tank, the orientation of the tank may be maintained during removal from the base unit, filling and reinsertion of the tank into the base. Unlike conventional tanks where the fill hole is located on the bottom wall of the tank, the present invention does not require the tank to be inverted for filling and further turned upright for subsequent insertion back into the base. Manipulating the tank as required for conventional bottom fill humidifiers is cumbersome and presents the possibility of the tank slipping from an individual's hands while performing the filling and reinsertion of the tank.

In addition, tank 62 may preferably be formed from a transparent or semi-transparent rigid polymer in order to permit an individual to determine through visual inspection whether the water supply needs to be replenished.

Although the illustrated embodiments of the present invention have been described herein with reference to the accompanying drawings, it is to be understood that the invention is not limited to those precise embodiments, and that various other changes and modifications may be effected therein by one skilled in the art without departing from the scope or spirit of the invention.

What is claimed is:

1. A humidifier comprising:

a base unit defining a reservoir for retaining a liquid;

a liquid supply tank supported by and positionable within said base unit, said tank having a bottom wall perimetrically bounded by an upper wall extending upwardly therefrom, said bottom wall having a valve means communicating with said reservoir, said tank further having an aperture defined by an aperture wall disposed on said tank in order to permit the liquid to be introduced into said tank;

a plug assembly having an outer diameter dimensioned for being insertable into said aperture, said plug assembly including means for increasing said outer diameter such that when said plug assembly is inserted in said aperture, actuation of said means for increasing said outer diameter urges said plug assembly against said aperture wall thereby sealing said aperture; and a humidification means for vaporizing the liquid and discharging the vaporized liquid into the environment.

2. A humidifier as defined in claim 1, wherein said tank aperture is formed on said tank upper wall.

3. A humidifier as defined in claim 2, wherein said tank upper wall includes a top wall having a side wall depending therefrom, and wherein said tank aperture is formed on said top wall.

4. A humidifier as defined in claim 1, wherein said aperture wall has a tapered profile.

5. A humidifier as defined in claim 1, wherein said plug assembly includes an interlocking means which is engagable with said base unit for preventing placement of said tank into said base unit if said tank aperture is not properly sealed.

6. A humidifier as defined in claim 1, wherein said plug assembly includes a plug formed of an elastomeric material, said plug includes a top and bottom end, and wherein said means for increasing said outer diameter urges said top and bottom ends axially together resulting in an increase of said plug assembly outer diameter.

7. A humidifier as defined in claim 6, wherein said means for increasing said outer diameter includes;

a connecting rod having two ends extending through said plug;

an actuator rotatably connected to one end of said connecting rod; and a stop fixedly secured to said other end of said connecting rod, such that upon rotation of said actuator said plug is compressed toward said stop thereby increasing said outer diameter of said plug assembly.

8. A humidifier as defined in claim 7, wherein said actuator is movable between a closed sealing position and an opened unsealing position, and wherein said plug assembly further includes an interlocking means, such that when said plug assembly is inserted into said tank aperture and said actuator is in said opened position, said interlocking means prevents said tank from being properly positioned within said base unit.

9. A humidifier as defined in claim 7, wherein said actuator includes a first and second cam portion, such that when said actuator is in said closed position said first cam portion engages said plug and urges said plug toward said stop thereby increasing said plug assembly outer diameter, and when said actuator is moved into said opened position said second cam causes said plug to linearly expand and said outer diameter to contract.

10. A humidifier as defined in claim 9, wherein said plug assembly further includes a rigid plate disposed between said plug and said actuator, said plate providing a bearing surface to permit a force imparted from said actuator to said plug to be uniformly distributed over said plug.

11. A humidifier as defined in claim 8, wherein said interlocking means includes said actuator, said actuator having a lever which extends outwardly in a radial direction when said actuator is in said closed position and said lever extends in an axial direction when said actuator is in said opened position, such that when said plug assembly is inserted into said tank aperture and said actuator is in said opened position, said lever engages said base unit thereby preventing said tank from being properly positioned within said base unit.

12. A humidifier as defined in claim 10, wherein said interlocking means includes an upper portion disposed on said base unit, and upon positioning said tank within said base unit when said actuator is in said opened position, said plug assembly interferes with said upper portion of said base unit thereby preventing proper placement of said tank in said base unit.

13. A humidifier as defined in claim 2, wherein said valve means includes a valve stem having two ends, said valve stem being slidably secured in said tank bottom wall between an open and closed position;

a sealing element secured to one of said ends of said valve stem;

a biasing means disposed about said valve stem for urging said sealing element into said closed position;

and wherein said base unit includes an actuator member, said actuator member being engagable with said valve stem to move said valve stem into said open position when said tank is positioned within said base unit thereby permitting the flow of the liquid and air out of and into said tank.

14. A water storage tank for use with a humidifier comprising:

a housing having a hollow interior and an upper and a bottom wall, said bottom wall having a valve means for permitting water to exit said tank, said upper wall having an aperture therein defined by an annular aperture wall, said aperture allowing water to be introduced into said tank;

a plug assembly being insertable into said aperture for sealing said aperture, said plug assembly including an elastomeric plug and means for expanding a diameter of said plug, such that said plug engages said aperture walls resulting in the sealing of said aperture.

15. A tank as defined in claim 14, wherein said plug includes two opposed ends and said expanding means compresses said ends together in a linear direction thereby increasing said diameter of said plug.

16. A tank as defined in claim 15, wherein said aperture wall extends from said upper wall toward said tank interior and said plug engages said aperture wall over a portion of the length of said aperture wall.

17. A tank as defined in claim 16, wherein said expanding means includes a connecting rod having two ends extending through said plug;

an actuator rotatably connected to one end of said connecting rod; and a stop fixedly secured to said other end of said rod, such that upon rotation of said actuator, said plug is compressed toward said stop thereby increasing said diameter of said plug.

18. A tank as defined in claim 17 wherein said actuator is movable between a first and a second position, said actuator including a lever extending outwardly in a radial direction when said actuator is in said first position and said lever extends in an axial direction when said actuator is in said second position, such that said lever in said second position is engagable with a humidifier base unit.

19. A tank as defined in claim 18, wherein said plug has a uniform cylindrical cross-section throughout its length.

20. A tank as described in claim 19 wherein said aperture has a tapered diameter with said diameter decreasing as said aperture wall extends towards said hollow interior.

21. A water storage tank for use with a humidifier comprising:

a housing having a hollow interior and an upper and bottom wall, said upper wall having an aperture therein defined by an aperture wall, said aperture allowing water to be introduced into said tank, said bottom wall having a valve means for permitting water to exit said tank;

a plug assembly being insertable into said aperture for sealing said aperture, said plug assembly including, a plug having a first outer diameter dimensioned to permit entry of said plug into said aperture, an actuatable locking means such that upon actuation of said locking means said plug diameter is increased to a second diameter dimensioned to abut said aperture wall when said plug is inserted into said aperture thereby sealing said aperture.

22. A humidifier comprising:

a base unit having a upwardly extending side wall ending in a rim, said side wall defining a base reservoir for holding water, said base unit further including a upper portion disposed above said reservoir, said upper portion defining an engagement surface spaced from said rim;

a water supply tank having a fill aperture disposed thereon and a valve means communicating with said reservoir, said tank being positionable within said base unit;

a plug assembly being insertable within said fill aperture for sealing same, said plug assembly including an interlocking means which is engagable with said base unit engagement surface to prevent placement of said tank into said base unit if said fill aperture is not properly sealed;

a humidification means for vaporizing water and discharging the vapor into the environment.

* * * * *